US006399563B1

(12) United States Patent
Durbut et al.

(10) Patent No.: US 6,399,563 B1
(45) **Date of Patent: *Jun. 4, 2002**

(54) ALL PURPOSE LIQUID CLEANING COMPOSITIONS

(75) Inventors: Patrick Durbut, Verviers; Guy Broze, Grace-Hollogne, both of (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/941,051

(22) Filed: Aug. 28, 2001

Related U.S. Application Data

(63) Continuation-in-part of application No. 09/503,002, filed on Feb. 11, 2000, which is a continuation-in-part of application No. 09/309,408, filed on May 10, 1999, now abandoned, which is a continuation-in-part of application No. 09/275,557, filed on Mar. 24, 1999, now abandoned.

(51) Int. Cl.[7] ..... C11D 17/00; C11D 15/00
(52) U.S. Cl. ..... 510/413; 510/414; 510/499
(58) Field of Search ..... 510/413, 414, 510/499, 365, 364

(56) References Cited

U.S. PATENT DOCUMENTS 6,140,288 A * 10/2000 Durbut et al. ..... 510/235

* cited by examiner

*Primary Examiner*—Gregory Delcotto
*Assistant Examiner*—John M. Petruncio
(74) *Attorney, Agent, or Firm*—Richard E. Nanfeldt

(57) ABSTRACT

An improvement is described in all purpose liquid cleaning composition which are especially effective in the removal of oily and greasy soil containing a nonionic surfactant, a liquid crystal suppression additive and water.

8 Claims, No Drawings

ALL PURPOSE LIQUID CLEANING COMPOSITIONS

RELATED APPLICATION

This application is a continuation in part application of U.S. Ser. No. 09/503,002 filed Feb. 11, 2000, pending which in turn is a continuation in part application of U.S. Ser. No. 09/309,408 filed May 10, 1999, abandoned which in turn is a continuation in part application of U.S. Ser. No. 09/275,557 filed Mar. 24, 1999, abandoned.

FIELD OF THE INVENTION

The present invention relates to an all purpose or microemulsion cleaning composition containing an additive which prevents the formation of a liquid crystal composition.

BACKGROUND OF THE INVENTION

This invention relates to an improved all-purpose liquid cleaning composition or a microemulsion composition designed in particular for cleaning hard surfaces and which is effective in removing grease soil and/or bath soil and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc.. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in tum, leads to the need for thorough rinsing which has been found to be undesirable to today's consumers.

SUMMARY OF THE INVENTION

The present invention provides an improved, microemulsion or all purpose clear, liquid cleaning composition having improved interfacial tension which improves cleaning hard surface and is suitable for cleaning hard surfaces such as plastic, vitreous and metal surfaces having a shiny finish, oil stained floors, automotive engines and other engines. More particularly, the improved cleaning compositions exhibit good grease soil removal properties due to the improved interfacial tensions, when used in diluted form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions contain an additive which impedes the formation of a liquid crystal composition.

Surprisingly, these desirable results are accomplished even in the absence of polyphosphate or other inorganic or organic detergent builder salts and also in the complete absence or substantially complete absence of grease-removal solvent.

This invention generally provides a stable, all purpose, or a microemulsion hard surface cleaning composition especially effective in the removal of oily and greasy oil. The all purpose liquid cleaning or microemulsion composition includes, on a weight basis:

- 2% to 22% of a nonionic surfactant containing ethoxylate groups;
- 0 to 20%, more preferably 0.1% to 18% of an anionic surfactant;
- 0 to 15%, more preferably 0.1% to 10% of a water-mixable glycol ether cosurfactant having either limited ability or substantially no ability to dissolve oily or greasy soil;
- 0 to 2.5%, more preferably 0.1% to 2% of a fatty acid;
- 0 to 3%, more preferably 0. 1% to 2% of a polymeric thickener;
- 0 to 15% of magnesium sulfate heptahydrate;
- 0 to 0.3% of a water insoluble perfume;
- 0.1% to 5% of an additive which suppresses liquid crystal formation; and
- the balance being water, wherein the composition does not contain more than 0.30% of a perfume and does not contain a water insoluble hydrocarbon having 6 to 18 carbons or an essential oil and the composition does not contain choline chloride, polyethylene glycol, polyvinyl pyrrolidone, a fatty or partially esterified ethoxylated polyhydric alcohol. The instant cleaning compositions are homogenous, one phase cleaning solutions.

DETAILED DESCRIPTION OF THE INVENTION

The present invention relates to a stable all purpose liquid cleaning or microemulsion cleaning composition comprising approximately by weight: 2.0% to 22% of a nonionic surfactant containing ethoxylate groups, 0 to 20%, more preferably 0.1% to 18% of an anionic surfactant, 0 to 3%, more preferably 0.1% to 2% of a polymeric thickener, 0 to 15%, more preferably 0.1 % to 10% of a glycol ether cosurfactant, 0 to 2.5%, more preferably 0.1% to 2% of a fatty acid, 0 to 0.3% of a water insoluble perfume, 0 to 15% of magnesium sulfate heptahydrate, 0.1% to 5% of an additive which suppresses liquid crystal formation and the balance being water, wherein the composition does not contain more than 0.3 wt. % of a perfume and does not contain an essential oil or a water insoluble hydrocarbon having 6 to 18 carbon atoms and the composition does not contain choline chloride, polyethylene glycol, polyvinyl pyrrolidone, a fully or partially esterified ethoxylated polyhydric alcohol.

Also excluded from the instant compositions are anionic surfactants having the formula $R'(C_6H_3SO_3^-)$—O—$(C_6H_3SO_3^-)R'(nM)$# wherein each R' is an alkyl, or alkylene, group containing from about 6 to about 12 carbon atoms, preferably from about 8 to about 10 carbon atoms, more preferably about 10 carbon atoms: M is a compatible cation, preferably an alkali metal, ammonium, or alkanolammonium cation, more preferably sodium; and n times the valence of M is equal to 2, amphoteric/zwitterionic surfactants, alkoxylated polyhydric alcohols, polymers containing vinyl pyrrolidone, monoalkanols, acrylic emulsions of 2-methyl-propenoic acid copolymer with ethyl-2-propenoate and propenoic acid, nonionic surfactants containing an amide group, amine oxides, quaternary amine salts, a polar solvent being selected from the group consisting of benzyl alcohol, polyethoxylated phenols containing from 2 to 6 ethoxy groups, phenylethyl alcohol, mono $C_6$–$C_9$ alkyl ethers of ethylene glycol, di-$C_4$–$C_9$ alkyl ethers of ethylene glycol, and mixtures thereof, and a buffering system comprising at least one buffer selected from the group consisting of: guanidine derivatives, ammonium or alkanine earth carbamates, diammonium carbamates, alkanolamines, ammonium or alkaline earth hydroxide, ammonia, alkoxyalkylamines, alkyleneamines, and mixtures thereof.

The nonionic surfactant which constitutes the major ingredient in present liquid detergent is present in amounts of 2.0% to 22%, preferably 3% to 17% by weight of the composition and provides superior performance in the removal of oily soil and mildness to human skin.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethylene oxide chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isooctyl phenol condensed with 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a etheric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

Suitable water-soluble non-soap, anionic surfactants used in the instant compositions include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an α-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos.. 2,503,280; 2,507,088; 3,260,744; 3,372,188; and German Patent 735,096.

Examples of satisfactory anionic sulfate surfactants are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)_n\ OSO_3M$ wherein n is 1 to 12, preferably 1 to 5, and M is a metal cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These surfactants can be prepared by reacting an alkyl phenol with 2 to 6 moles of ethylene oxide and sulfating and neutralizing the resultant ethoxylated alkylphenol.

Other suitable anionic surfactants are the $C_9$–$C_{15}$ alkyl ether polyethenoxyl carboxylates having the structural formula $R(OC_2H_4)_nOX\ COOH$ wherein n is a number from 4 to 12, preferably 5 to 10 and X is selected from the group consisting of $CH_2$, $C(O)R_1$ and

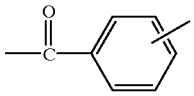

wherein $R_1$ is a $C_1$–$C_3$ alkylene group. Preferred compounds include $C_9$–$C_{11}$ alkyl ether polyethenoxy (7-9) $C(O)CH_2CH_2COOH$, $C_{13}$–$C_{15}$ alkyl ether polyethenoxy (7-9)

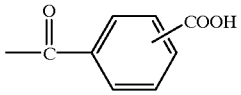

and $C_{10}$–$C_{12}$ alkyl ether polyethenoxy (5-7) CH2COOH. These compounds may be prepared by considering ethylene oxide with appropriate alkanol and reacting this reaction product with chloracetic acid to make the ether carboxylic acids as shown in U.S. Pat. No. 3,741,911 or with succinic anhydride or phthalic anhydride. Obviously, these anionic surfactants will be present either in acid form or salt form depending upon the pH of the final composition, with salt forming cation being the same as for the other anionic surfactants.

The water soluble glycol ether cosurfactant is present in the composition at a concentration of 0 to 15 wt. % and more preferably 0.1 wt. % to 10 wt. %. The water soluble glycol ether contains a branched chain alkyl group such as a tertiary butyl group and the glycol ether is selected from the group consisting of propylene glycol mono-t-butyl ether,di, tripropylene glycol mono-t-butyl ether. Other satisfactory glycol ethers are ethylene glycol mono-t-butyl ether, diethylene glycol mono-t-butyl ether, tri, and tetraethylene glycol mono-t-butyl ether, mono, di, tributylene glycol mono-t-butyl ether. The use of glycol ethers such as ethylene glycol monobutyl ether (butyl cellosolve), diethylene glycol monobutyl ether (butyl carbinol), propylene glycol monomethyl ether, dipropylene glcyol monomethyl ether, triethylene glycol monobutyl ether, mono, di, tripropylene glycol monobutyl ether, tetraetylene glycol monobutyl ether, mono, di, tripropylene glycol monomethyl ether, ethylene glycol monohexyl ether, diethylene glycol monohexyl ether, ethylene glycol monoethyl ether, ethylene glcyol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monopropyl ether, triethylene glycol monoethyl ether, triethylene glycol monomethyl ether, triethylene glycol monopentyl ether, triethylene glycol monohexyl ether, mono, di, tripropylene glycol monopropyl ether, mono, di, tripropylene glycol monoethyl ether, mono, di, tripropylene glycol monopentyl ether, mono, di, tripropylene glycol monohexyl ether, mono, di, tributylene glycol monomethyl ether, mono, di, tributylene glycol monohexyl ether, mono, di, tributylene glycol monopropyl ether, mono, di, tributylene glycol monoethyl ether, mono, di, tributylene glycol monopentyl ether, mono, di, tributylene glycol monobutyl ether is also suitable so as to form microemulsion compositions, but are not preferred cosurfactants, because they do deliver same effect as glycol ether containing branched chain alkyl group on the formation of liquid crystal compositions. They can nevertheless be used, providing other liquid crystal suppression additives are used in instant compositions. The use of glycol ethers such as diethylene glycol mono-n-butyl ether which does not contain a branched chain alkyl group are not as efficient as the above branched glycol ethers in impairing liquid crystal formation. Accordingly, glycol ethers such as glycol mono-n-butyl ether are not preferred glycol ethers in the instant compositions.

The additive used to suppress liquid crystal formation is present at a concentration of about 0.1 wt. % to 5.0 wt. %, more preferably 0.2 wt. % to 3 wt. %. The liquid crystal suppression additives are selected from the group consisting of a $C_7$–$C_{12}$ N-alkyl pyrrolidone such as N-octyl pyrrolidone, a 1,2 alkane diol having 5 to 10 carbon atoms such as 1,2 hexanediol, an organic diester having the general molecular structure R—COO—(C2H40)n-CO—R, in which R is an alkyl chain ranging from C7 to C17, arising from a fatty acid ranging from octanoic to stearic acid, and n being the number of ethylene glycol groups of the polyethylene glycol chain between the two ester moities in the molecule, and n ranging from n=2 to n=20. Typical examples of such ethoxylated diesters are PEG-4 dilaurate, PEG-12 distearate. Another additive is a $C_8$–$C_{10}$ alkene carbonate.

The final essential ingredient in the inventive all purpose cleaning compositions having improved interfacial tension properties is water. The proportion of water in the microemulsion or all purpose hard surface cleaning composition compositions generally is in the range of 10% to 97%, preferably 70% to 97% by weight.

In addition to the above-described essential ingredients required for the formation of the instant composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

The instant compositions can include from 0% to 2.5%, preferably from 0.1% to 2.0% by weight of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 2.5 wt. % of a fatty acid is used in the instant compositions, the composition will become unstable at low temperatures as well as having an objectionable smell. As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

When a $C_8$–$C_{22}$ fatty acid or fatty acid soap is included in compositions as a foam suppressant, it has been found useful for the purpose of the invention to also add neutralized polyacrylic acid polymer having a low molecular weight ranging from about 10,000 to 45,000. Typical example is Norasol LMW-20N from Norsohaas, having an average molecular weight of 20,000. Low molecular weight polyacrylate polymers can be used in admixture with said additives used to suppress liquid crystal formation. Low molecular weight polyacrylate polymer is present at a concentration of about 0 to 3 wt. %, more preferably 0.1 wt. % to 2 wt. %.

The all-purpose liquid or microemulsion cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose hard surface liquid or microemulsion cleaning compositions exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquids are readily pourable and exhibit a viscosity in the range of 6 to 60 milliPascal . second (mPas.) as measured at 25° C. with a Brookfield RVT Viscometer using a #1 spindle rotating at 20 RPM. Preferably, the viscosity is maintained in the range of 10 to 40 mpas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the compositions, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary surfactants and cosurfactants can be separately prepared and combined with each other. The magnesium salt, or other multivalent metal compound, when present, can be added as an aqueous solution thereof or can be added directly. It is not necessary to use elevated temperatures in the formation step and room temperature is sufficient.

The instant compositions explicitly exclude alkali metal silicates and alkali metal builder salts such as alkali metal polyphosphates, alkali metal carbonates, alkali metal bicarbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing at 25° C.:

| | A | B | C | D | E | F | G |
|---|---|---|---|---|---|---|---|
| Neodol 25-7 (C12–C15 E07) | 7.0 | 7.0 | 7.0 | 7.0 | 7.0 | 7.0 | 7.0 |
| 1,2-Hexanediol | — | 0.7 | — | — | | — | 1.75 |
| Octene carbonate (C8AKC) | — | — | 0.7 | — | — | — | — |
| N-Octyl pyrrolidone | — | — | — | 0.7 | — | — | — |
| n-Butyl urea | — | — | — | — | 0.7 | — | — |
| Decene carbonate (C10AKC) | — | — | — | — | — | 0.7 | — |
| Water | Bal. | Bal. | Bal. | Bal. | Bal. | Bal. | Bal. |

Two independent residue tests were performed on black polymethylmethacrylate (PMMA) tiles, with two series of Samples. Samples A, B, and C were used in test number 1, and Samples A, D, E, and F in test number 2.

| Independent tests | Compositions | Equivalence | | | Mean |
|---|---|---|---|---|---|
| 1 | B | a | | | 4.6 |
| | C | | b | | 3.4 |
| | A | | b | | 3.3 |
| 2 | D | a | | | 3.8 |
| | A | | b | | 2.6 |
| | E | | b | c | 1.7 |
| | F | | | c | 1.3 |

Standard test conditions: 12 g/L dilution of compositions in tap water having a 300 ppm water hardness expressed as CaCO3. Composition "A" is taken as reference in each independent test. A score is attributed by panelists to each product, on a scale from 0 to 10, respectively for heavy residues (very bad case: 0 score) and for no visible residues (10 score). In each test, products having the same letter are not significantly different according to analysis of variance (Student-Newman-Keuls test; 95% confidence). Best product is ranked "a".

Further residue test was performed on black polymethylmethacrylate (PMMA) tiles, with Samples A, B and G from Example 1.

| Independent tests | Compositions | Equivalence | | | Mean |
|---|---|---|---|---|---|
| 1 | G | a | | | 2.7 |
| | B | a | b | | 2.1 |
| | A | | b | c | 1.5 |

Test conditions are the same as described for two above independent tests.

EXAMPLE 2

The following compositions in wt. % were prepared:

| | A | B | C | D |
|---|---|---|---|---|
| Linear alkyl (C9–C13) benzene sulfonate, sodium salt (NaLAS) | 12.0 | — | 12.0 | — |
| Neodol 25-7 (C12–C15 EO7) | 3.0 | 7.0 | 3.0 | 7.0 |
| MgSO4.7H2O | 4.0 | — | 4.0 | — |
| 1,2-Hexanediol | — | — | 1.75 | 1.75 |
| Water | Bal. | Bal. | Bal. | Bal. |

Residue test was performed on black polymethylmethacrylate (PMMA) tiles, with Samples A, B, C, and D.

| Independent tests | Compositions | Equivalence | | Mean |
|---|---|---|---|---|
| 1 | A | a | | 5.1 |
| | C | a | | 4.8 |
| | D | | b | 1.8 |
| | B | | b | 1.7 |

Test conditions: compositions A and B are first diluted to 7% total surfactant concentration with deionized water. To run the test, we used a 12 g/L concentration of these solutions in tap water having a water hardness of 300 ppm expressed as CaCO3. Compositions C and D are directly diluted in tap water (12 g/L product dosage). Composition "B" is taken as reference. A score is attributed by panelists to each product, on a scale from 0 to 10, respectively for heavy residues (very bad case: 0 score) and for no visible residues (10 score). In each test, products having the same letter are not significantly different according to analysis of variance (Student-Newman-Keuls test; 95% confidence). Best product is ranked "a".

EXAMPLE 3

The following compositions in wt. % were prepared:

| | A | B | C | D | E | F |
|---|---|---|---|---|---|---|
| Linear alkyl (C9–C13) benzene sulfonate, magnesium salt (MgLAS) | 10.5 | 10.5 | 10.5 | 10.5 | 10.5 | 10.5 |
| Neodol 91-8 (C9–C11 EO8) | 3.5 | 3.5 | 3.5 | 3.5 | 3.5 | 3.5 |
| Coco fatty acid | 1.4 | 1.4 | 1.4 | 1.4 | 1.4 | 1.4 |

-continued

| | A | B | C | D | E | F |
|---|---|---|---|---|---|---|
| Propylene glycol mono-t-butyl ether (PTB) | — | 4.0 | 4.0 | 4.0 | 4.0 | — |
| Diethylene glycol mono-n-butyl ether (DEGMBE) | 4.0 | — | — | — | — | 4.0 |
| 1,2-Hexanediol | — | — | 3.5 | 3.5 | — | 3.5 |
| Norasol LMW-20N | — | — | — | 0.2 | 0.2 | 0.2 |
| Water | Bal. | Bal. | Bal. | Bal. | Bal. | Bal. |

The pH in all compositions A–F in Example 3 is adjusted to pH=7.0 through addition of sodium hydroxide.

Residues test was performed on black polymethylmethacrylate (PMMA) tiles, with Samples B–F.

| Independent tests | Compositions | Equivalence | | | Mean |
|---|---|---|---|---|---|
| 1 | C | a | | | 4.6 |
| | D | a | b | | 4.1 |
| | F | a | b | c | 3.6 |
| | E | a | b | c | 3.6 |
| | B | | | c | 2.8 |

Test conditions: compositions B–F are first diluted to 7% total surfactant concentration with deionized water. To run the test, we used a 12 g/L concentration of these solutions in tap water having a water hardness of 300 ppm expressed as CaCO3. Composition "B" is taken as reference. A score is attributed by panelists to each product, on a scale from 0 to 10, respectively for heavy residues (very bad case: 0 score) and for no visible residues (10 score). In each test, products having the same letter are not significantly different according to analysis of variance (Student-Newman-Keuls test; 95% confidence). Best product is ranked "a".

What is claimed:

1. An all purpose liquid cleaning composition comprising:

(a) 2 wt. % to 22 wt. % of a nonionic surfactant containing ethoxylate groups;

(b) 0.1 wt. % to 5 wt. % of a liquid crystal suppression additive; and (c) the balance being water.

2. The composition of claim 1 which further contains a salt of a magnesium salt.

3. The composition of claim 1 further including a fatty acid which has 8 to 22 carbon atoms.

4. The composition of claim 1 which contains from 0.1 to 15% by weight of a glycol ether cosurfactant which contains t-butyl groups.

5. The composition of claim 1 wherein the liquid crystal suppression additive is a 1,2-alkane diol having 5 to 10 carbon atoms.

6. The composition of claim 1 wherein said liquid crystal suppression additive is a $C_7$–$C_{12}$ N-alkyl pyrrolidone.

7. The composition of claim 1 further including 0.1 wt. % to 20 wt. % of an anionic surfactant.

8. The composition of claim 7 further including 0.1 wt. % to 2.0 wt. % of a polymeric thickener.

* * * * *